United States Patent [19]

Moser et al.

[11] 4,197,015

[45] Apr. 8, 1980

[54] PORTABLE MIXING APPARATUS

[76] Inventors: Paul Moser, 45 Indian Rd.; Robert Moser, 65 Chestnut Dr., both of Wayne, N.J. 07470

[21] Appl. No.: 3,277

[22] Filed: Jan. 15, 1979

[51] Int. Cl.[2] ..... B28C 7/16; B28C 5/20

[52] U.S. Cl. ..... 366/47; 366/63; 366/185

[58] Field of Search ..... 366/60, 62, 63, 54, 366/42, 45, 46, 47, 48, 189, 185

[56] References Cited

U.S. PATENT DOCUMENTS

| | | | |
|---|---|---|---|
| 2,683,026 | 7/1954 | Preszler | 366/63 |
| 3,158,361 | 11/1964 | Brenneke | 366/63 |
| 3,173,665 | 3/1965 | Hall | 366/47 |
| 3,578,292 | 5/1971 | Montague | 366/63 |
| 4,042,222 | 8/1977 | Clement | 366/47 |

*Primary Examiner*—Robert W. Jenkins
*Attorney, Agent, or Firm*—Daniel H. Bobis

[57] ABSTRACT

A portable mixing apparatus has a carriage assembly with at least a platform section and an upwardly extending handle section connected thereto, and the mixing apparatus can be manually moved. At least two roller assemblies having roller members therein are mounted on the platform section in predetermined spaced relation to each other for operative association with a bearing assembly which is preferably mounted for limited linear floating movement in the handle section, and with the outer surface of a mixing bowl to be mounted on said roller members. An axle extends from the closed end of the mixing bowl and when the mixing bowl is mounted in the roller members the axle will be aligned with and can be detachably connected in the bearing assembly so that the axis of rotation of the mixing bowl is substantially parallel to the plane of the platform. At least one roller member is disposed in driving engagement with said outer surface of the mixing bowl generally adjacent the closed end, and a drive assembly mounted on the mixing apparatus has a driving motor on the underside of the platform section which is connected to the driving roller member so as to provide a desired optimum speed of rotation for the mixing bowl.

Additionally, the above described portable mixing apparatus may have wheels connected to the platform section, and front and rear legs in operative association with the platform section, to permit the mixing apparatus to be pivoted about the axis of the wheels for discharging mixed material from the open end of the mixing bowl.

14 Claims, 10 Drawing Figures

PORTABLE MIXING APPARATUS

BACKGROUND OF THE INVENTION

This invention relates generally to mixing apparatus and more particularly to a relatively small mixing apparatus for mixing and/or transporting the mixed material therein from place to place which is readily adaptable for use by the homes craftsman or the home handyman.

Portable apparatus for mixing cement or other materials or for the tumbling of objects therein and for transporting the same are known in the art as is shown in U.S. Pat. Nos. 2,492,895, 2,808,241, 2,813,705, 2,859,950, 3,084,714 and 3,655,168.

Conventionally such machines comprise a wheeled supporting frame having a mixing drum rotatably mounted therein which is driven by a suitable motor and drive belt also mounted in the supporting frame.

The present invention provides an improved portable mixing apparatus wherein the supporting frame has driven rollers in predetermined spaced relation disposed to engage, support and rotate therein a mixing-bowl defining a mixing chamber and having an open end, a closed end, and an axle extending rearwardly therefrom in the axis of rotation for the mixing chamber which is detachably connected to a bearing assembly mounted in the supporting frame with limited floating motion to absorb uneven or unbalanced rotation of the mixing bowl during rotation thereof and so related to the supporting rollers that when the portable mixing apparatus is at rest the open end of the mixing bowl will face upwardly for the changing of material to be mixed into the mixing chamber. And handle means are provided to permit the mixing apparatus to be moved and to be tilted for discharging the contents of the mixing chamber from the open end of the mixing bowl.

SUMMARY OF THE INVENTION

Thus the present invention covers a portable mixing apparatus including, a carriage assembly having, a platform section with wheel means thereon for moving said portable mixing apparatus from place to place, and a handle and support section extending upwardly therefrom in a generally vertical plane, bearing assembly means mounted for limited floating movement in the handle and support section and spaced roller assembly means connected to the platform section provide a three point mounting in the carriage assembly for a mixing bowl means. The mixing bowl means defines a mixing chamber having an open end for charging and discharging materials, into and out of the mixing bowl, a closed end, and axle means extending from the closed end. The mixing bowl is in operative contact with roller members on the spaced roller assembly means and is disposed to permit the axle means to be rotatably and detachable connected in the said bearing assembly means for limited oscillatory movement of said mixing bowl during rotation thereof, and power drive means for driving at least one given roller member for rotating the mixing bowl in assembled position on the carriage assembly.

Accordingly, it is an object of the present invention to provide a relatively light mixing apparatus which can be moved from place to place as may be necessary for on the spot use of the material mixed therein.

It is another object of the present invention to provide a portable mixing apparatus which is relatively cheap to manufacture and therefore is readily available to the home handyman or do-it-yourself craftsman.

It is another object of the present invention to provide a portable mixing apparatus which can be supplied in broken down form and can be easily assembled by the home handyman or do-it-yourself craftsman.

It is another object of the present invention to provide a portable mixing apparatus having spaced rotatable support members at least one of which is driven by a suitable driving assembly, for cradling or mounting the mixing bowl for the portable mixing apparatus therein, and for driving the same without jamming.

It is another object of the present invention to provide a portable mixing apparatus wherein the mixing bowl in mixing position is tilted with the open end extended upwardly at an angle such that the mixing bowl can be easily charged and can contain a larger quantity of material for mixing therein.

It is another object of the present invention to provide a portable mixing apparatus which includes a bearing assembly for holding the back end of the mixing bowl of the portable mixing apparatus therein and for detachably connecting the back end of the mixing bowl to the bearing assembly so that it can be easily removed from the mixing apparatus for cleaning, and to provide limited floating motion for the bearing means and mixing bowl during the rotation of the mixing bowl to allow for eccentricities arising from the manufacture and/or warpage of the mixing bowl when loaded or for any other reason when the same is rotated during operation of the portable mixing apparatus.

These and other objects and advantages will become apparent by reference to the following detailed description of one form of the present invention taken in conjunction with the accompanying drawings in which.

FIG. *4b* is a fragmentary rear view of the detachable connection for the axle member of the mixing bowl.

FIG. *4c* is a view taken on line *4c—4c* on FIG. *4a*.

FIG. *4d* is a perspective view of the inner annular plastic member of the bearing assembly shown in FIG. *4c*.

Figures 4A, 4B, 4C, 4D, 5, 6, 7:
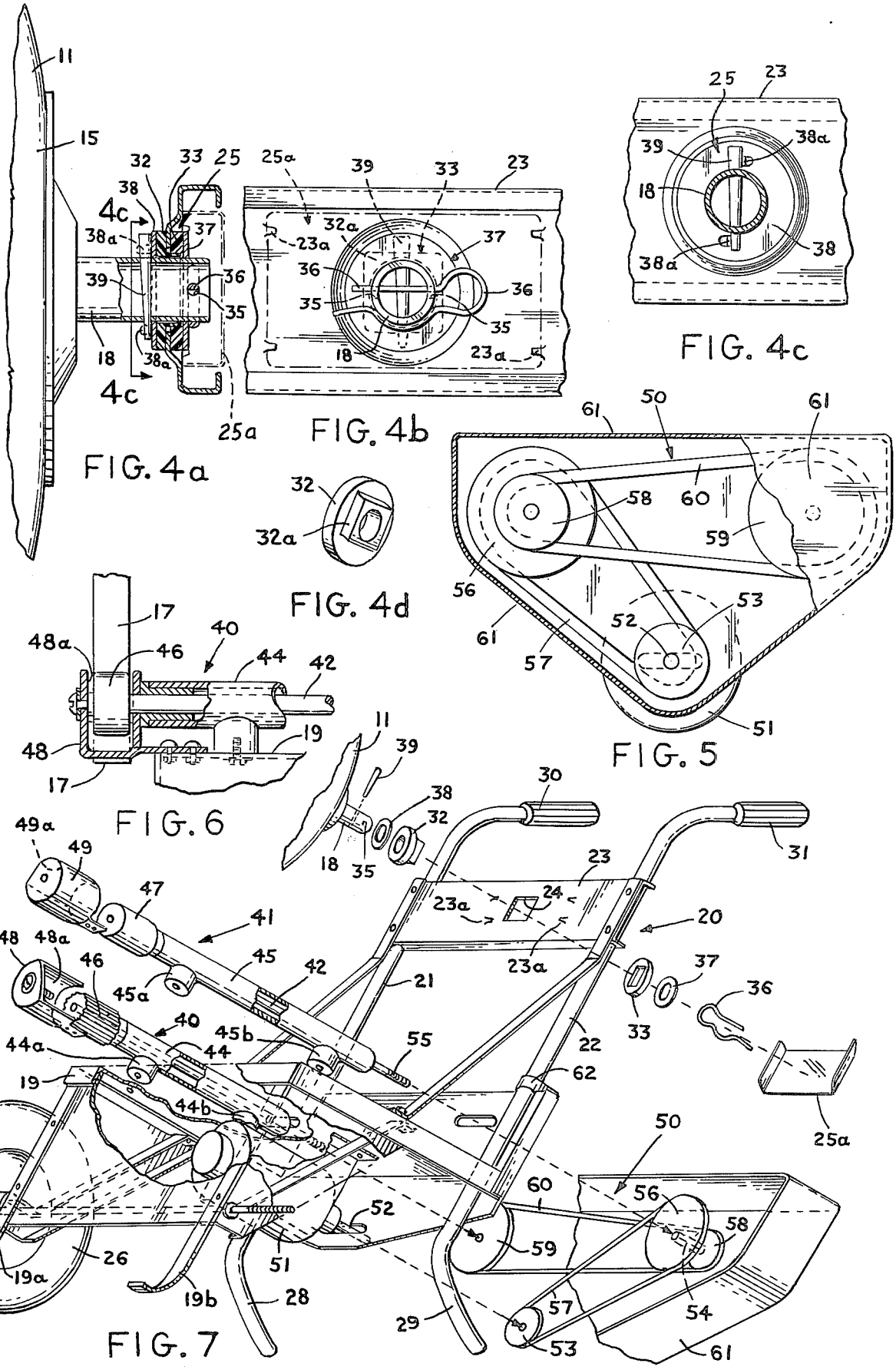

FIG. 5 is a back view of the drive belt from the motor to the rollers in the roller assemblies with cover removed.

FIG. 6 is a fragmentary top view of one end of the driven roller assembly.

Figure 1:
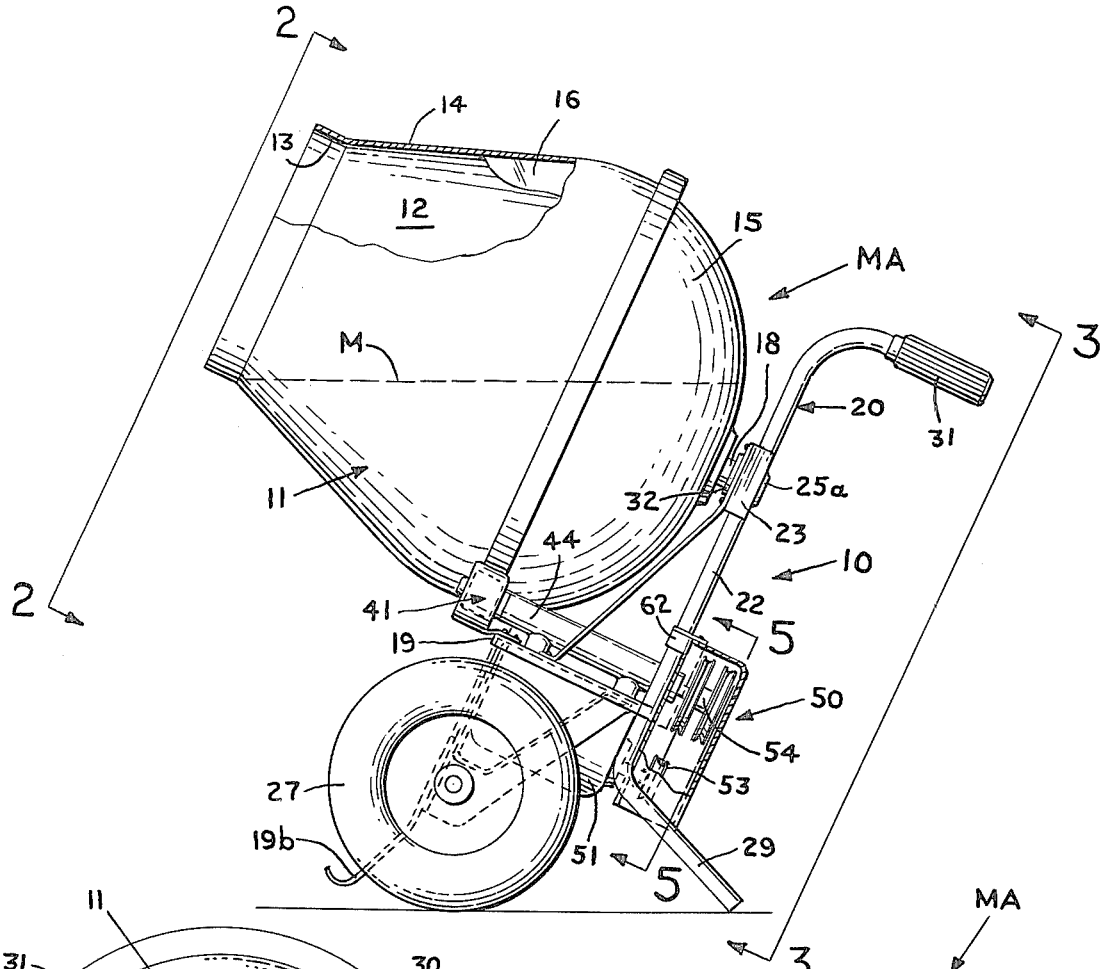
FIG. 1 is a side view of one form of portable mixing apparatus in accordance with the present invention.

FIG. 7 is an exploded view of the carriage assembly and drive assembly for the portable mixing apparatus shown in FIG. 1.

Referring to the drawings FIGS. 1 to 5 show one form of portable mixing apparatus generally designated MA in accordance with the present invention which includes a carriage assembly generally designated 10 and a mixing bowl 11 rotatably mounted therein as hereinafter described.

A mixing bowl for portable mixing apparatus similar to the type illustrated in the present invention is shown and disclosed in British Pat. No. 1,311,415.

Mixing bowl 11 is preferably molded, cast or fabricated of a suitable strong but light material such as fiberglass, sheet steel or plastic such as polyethylene and will be sized so as to define a mixing chamber 12 therein which can mix a maximum amount of material therein for the size of the mixing chamber and the angular position of the open end of the mixing bowl as hereinafter described.

Mixing bowl 11 has an open end 13 in communication with the mixing chamber 12 so that material can be charged through the open end 13 into the mixing chamber 12 and discharged therefrom when the portable mixing apparatus is tilted from the position shown in FIG. 1 where the open end faces upwardly to a position where the open end of the mixing bowl faces downwardly.

The mixing bowl has side walls as at 14 about the open end 13 which are conical in shape and continuous with the base of the side walls is a semi spherical closed end 15 so that the back or closed end portion of the chamber 12 is relatively larger, will readily accomodate the material M to be mixed, and provide a space in which to mix the material so that it will not escape from the upwardly facing open end of the mixing bowl 11 until the mixing apparatus MA is tilted so that the open end 13 of mixing bowl 11 faces downwardly.

The inner wall of the mixing chamber 12 has ribs 16 formed thereon to aid in agitating the material in the mixing chamber 12 when the mixing bowl is rotated by driving means which engages a friction member 17 disposed about the periphery of the mixing bowl generally in the area of the semi-spherical closed end as will be more fully described hereinafter.

Extending from the closed end 15 is an axle 18 which is disposed in the axis of rotation of the mixing bowl and provides means for rotatably mounting and detachably connecting the mixing bowl in the carriage assembly 10 now to be described.

CARRIAGE ASSEMBLY

The carriage assembly 10 is shown in FIGS. 1, 2, 3 and 7 as including, a base or platform section 19. Disposed vertically relative thereto and at an angle predetermined by the axis of rotation for the mixing bowl is a handle and support assembly generally designated 20.

The handle and support assembly 20 includes, spaced rods 21 and 22 respectively connected on opposite sides of the base or platform section 19 and a transverse cross member 23 is connected and fixed in position between the spaced rods 21 and 22 to strengthen the handle and support assembly. An enlarged substantially square opening as at 24 is formed in the medial section of the transverse member 23 for mounting a bearing assembly generally designated 25 in which the axle 18 will be rotatably and detachably connected.

Figure 3:
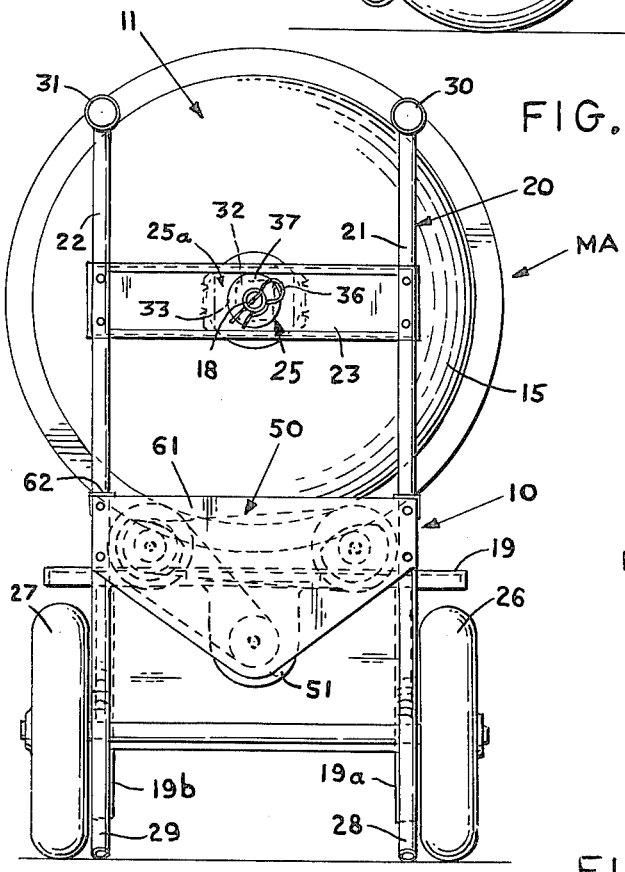
FIG. 3 is a rear view taken on line 3—3 of the portable mixing apparatus shown in FIG. 1, and FIG. *4a* is a fragmentary view of the back end of the mixing bowl showing the axle member thereon and the bearing assembly to permit the axle to be detachably connected therein as shown in cross-section.

The base or platform section 19 is provided with spaced wheel assemblies as at 26 and 27 on the respective opposite sides thereof. The lower ends as at 28 and 29 of the respective spaced rods 21 and 22 extend below the base or platform section 19 and are shaped to coact with the respective wheel assemblies 26 and 27 so that when the mixing apparatus is placed in a standing position the mixing bowl 11 will be disposed with the open end thereof facing upwardly as is shown in FIGS. 1 and 3 of the drawings.

Further the spaced rod members 21 and 22 are provided at their upper ends with handle members as at 30 and 31. The handle members can be grasped and the mixing apparatus tilted from the standing position by rotating the mixing apparatus about the respective wheel assemblies 26 and 27 until the open end of the mixing drum faces downwardly and the mixing apparatus MA is raised off the ground by the spaced outriggers as at 19*a* and 19*b* connected to the front end of the platform 19 of carriage assembly 10. These outriggers prevent skidding and rolling movement of the mixing apparatus so that the contents of the mixing chamber 12 can be easily discharged from the open end 13 of the mixing bowl 11.

As shown in FIGS. 4*a*, 4*b*, 4*c*, and 4*d* the bearing assembly 25 includes an inner annular plastic member 32 with a square projection 32*a* thereon and an outer annular plastic member 33 with a square bore 33*a* which are interfitted together. Any suitable plastic material such as nylon, or filled nylon may be utilized as the material for the innr annular plastic member 32 and outer annular plastic member 33.

The square opening 24 and the square projection 32*a* act to prevent the bearing assembly from rotating relative to the transverse cross-member 23. Further, however, the square opening 24 and the square projection 32*a* are so sized that the square projection 32*a* has a relatively sloppy or loose fit in the square opening 24.

In assembled position the inner annular plastic member 32 is disposed to abut against the inner or front face of the transverse cross-member 23 and the square projection 32*a* extends through the square opening 24 so that the outer annular plastic member 33 can interfit on the square projection 32*a* and as shown in FIG. 4*a* will abut against the outer or rear face of the transverse cross-member 23.

A bore 34 is formed in the inner annular plastic member 32 into which the axle of the mixing bowl 11 is inserted when the mixing bowl is assembled on the carriage assembly 10. However, because the square projection 32*a* fits relatively loosely into the square opening 24, limited floating oscillatory movement of the bearing assembly can occur when the mixing bowl is mounted and rotated in the bearing assembly 25, as will now be described.

Thus, by further reference to FIGS. 4*a* and 4*b*, the axle 18 is shown as having a length such that on insertion of the axle 18 into the bearing bore 34 it will extend through the interengaging inner plastic member 32 and outer plastic member 33, and the free end of the axle will extend beyond the rear face of an outer or rear washer 37. In order to detachably connect the mixing bowl 11 in this assembled position, the free end of the axle 18 remote from the point of connection to the back end of the mixing drum is provided with at least one or more cross bores as at 35 and a large outer Cotter type pin 36 will be inserted through one of the cross bores 35 to prevent the axle 18 from escaping when the mixing apparatus is tilted into the discharge position of the mixing bowl 11. The outer or rear washer 37 is provided between the Cotter pin 36 and the rear face of the annular outer plastic member 33 as a thrust bearing face against which the Cotter pin 36 can bear during rotation of the mixing bowl 11 and axle 18 in the operation of the mixing apparatus MA.

An inner or front washer 38 is provided adjacent the face of the inner annular plastic member 32 and an inner roll pin 39 coacts therewith and with the outer Cotter pin 37 to hold the approximate longitudinal position of the axle 18 and the mixing bowl 11 as detachably connected in the transverse member 23 of the carriage assembly. Stops 28*a* on inner washer 38 coact with pin 39.

As is shown in FIG. 1, 4*a*, 4*b* and 7, the back end of the bearing assembly 25 and the axle in assembled position are covered by a safety cover 25*a* which will be made of a suitably flexible material to permit the same to be snapped into assembled position in catches as at 23*a* struck in the transverse member 23.

The mixing bowl 11 is sized so that when the axle is in assembled position in the bearing assembly 25 as above described, the mixing bowl 11 will be cradled between spaced roller assemblies as at 40 and 41 connected to the upper face or platform section 19 of the carriage assembly 10. The roller assemblies 40 and 41 both support and will act to rotate the mixing bowl 11 by engagement with the friction member 17 on the outer periphery of the mixing bowl 11 when at least one of the roller assemblies are driven by suitable driving means generally designated 50 all of which is shown in FIGS. 1, 2, 3, 5, 6 and 7 of the drawings.

Each of the roller assemblies includes respectively, a roller member as at 42 and 43 which are rotatably supported in bushing housings at 44 for roller 42 and 45 for roller 43. The roller assemblies are fixedly connected to the upper face of the platform section 19 of the carriage assembly by threaded means which extend into the spaced bosses thereon as at 44*a* and 44*b* for roller assembly 40 and 45*a* and 45*b* for roller assembly 41. Roller assemblies 40 and 41 are spaced from each other a distance such that they will engage and support the friction member 17 in such a way as to form a three point support means with respect to the bearing assembly 25. The respective points of engagement between the rollers assemblies 40 and 41 and the friction member being bi-laterally equidistance from the vertical plane extending through the axle 18 and bearing assembly 25 and the axis of rotation for the mixing bowl 11, this distance being such that at least one of the roller assemblies will be able to engage and drive the friction member 17 without jamming during such rotation.

At least one of the rollers will be provided with a knurled enlargement as at 46, and the other may have a smooth enlargement as at 47 and these enlargements will further have removably connected safety covers as at 48 and 49 with openings as at 48*a* and 49*a* at where the enlargements 46 and 47 on the respective roller members 42 and 43 are disposed for contact with the friction member 17 on the outer periphery of the mixing bowl 11.

In the illustrated portable mixing apparatus MA, roller 42 is rotated by the power drive assembly 50 so as to in turn engage and rotate the friction member 17 and mixing bowl 11 about which the friction member is connected. The associated roller 43 will be simultaneously rotated and acts as an idler means to balance the thrust of the driving roller 42 and also to hold the friction member 17 and the associated mixing bowl 11 in the assembled position as above described.

As above indicated in order to allow for eccentricities that may occur for various reasons between this three point type of support and driving assembly, the bearing assembly will oscillate freely within the enlarged opening 24 in the transverse member 23 in which the bearing assembly 25 is mounted.

POWER DRIVE ASSEMBLY

The power drive assembly 50 for rotating the roller member 42 includes, an electric motor 51 which is disposed in a protected position and fixedly connected to the under or lower face of the platform section 19 of the carriage assembly 10.

Motor 51 is connected by a suitable chain of belts and pulleys to the roller member 42 so as to reduce and to provide suitable revolutions per minute thereto for proper rotation of the mixing bowl 11 as will now be described.

Thus, motor 51 is connected centrally of the underside of the platform section 19 and the shaft 52 thereon is connected to and directly drives the main drive pulley 53.

Main drive pulley 53 is connected to an intermediate assembly which includes an idler shaft 54 freely disposed for rotation on and about the outer end 55 of the roller member 42 as is shown in FIGS. 1 and 7 of the drawings. Fixedly connected at one end of the idler shaft 54 is a first intermediate pulley 56 which is connected to and driven by the main drive pulley 53 by means of the pulley belt 57.

The first intermediate pulley 56 is larger in diameter than the main drive pulley 53 by a 3 to 1 ratio so that the intermediate pulley 56 and the idler shaft 54 will be rotated at a slower speed than the speed at which the motor 51 drive the main drive pulley 53.

At the end of the idler shaft 54 remote from the first intermediate pulley 56 a second intermediate pulley 58 is fixedly connected and rotatable therewith. The pulley 58 is smaller in diameter than the pulley 56 and in turn drives the roller drive pulley 59 through the roller drive pulley belt 60.

Since the roller drive pulley 59 is larger in diameter than the second intermediate pulley 58 by a ratio of 3 to 1 the roller drive pulley will be rotated even more slowly than the intermediate idler assembly 53 so that it will be driving the roller 42 to which it is connected at this same lesser speed than the original speed of the motor 51 by a ratio of approximately 6 to 1. This permits a conventional electric motor 51 to drive and rotate the mixing bowl 11 at a speed more ideally suited to mixing the types of material such as cement for which the portable mixing assembly is particularly adapted.

As is shown in FIG. 1, 3 and 7 the power drive assembly 50 is covered by a power drive assembly guide 61 which is connected as by bracket means 62 to the handle and support assembly 20 as is shown in FIGS. 1, 3 and 7 of the drawings.

OPERATION

Figure 2:
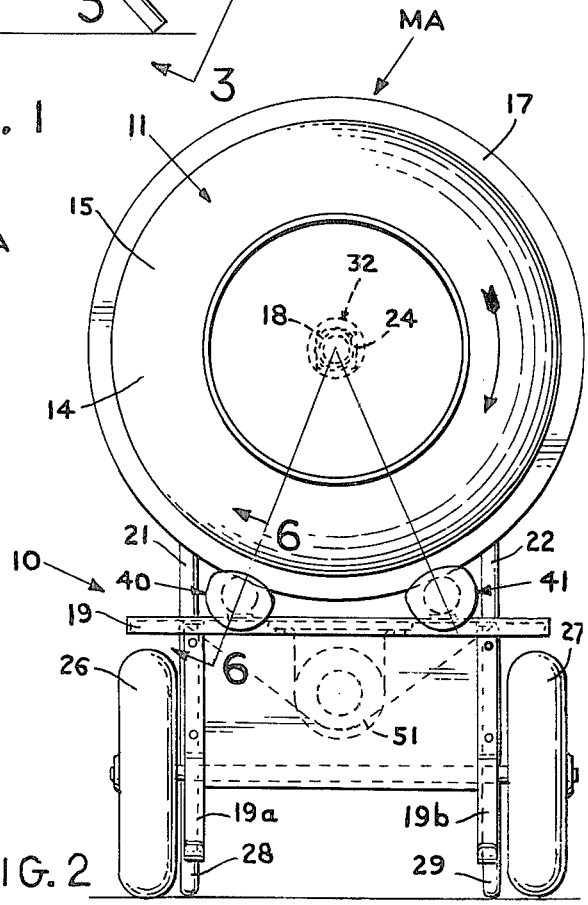
FIG. 2 is a front view taken on line 2—2 of the portable mixing apparatus shown in FIG. 1.

In the operation of the above described portable mixing apparatus, the mixing bowl is assembled empty by passing the axle 18 through the bore 34 in the bearing assembly 25 and clamping the mixing bowl in assembled position by means of the outer Cotter pin 36 and inner roll pin 39. The mixing bowl is then adjusted so that the friction engaging members 17 rest on the knurled and smooth enlargements 46 and 47 of the roller members 42 and 43 of the roller assemblies 40 and 41 as is shown in FIGS. 1, 2 and 3 of the drawings.

When the portable mixing apparatus MA is at rest as is shown in FIG. 1 the open end 13 of the mixing bowl will be approximately 2½' off the ground. This will permit the user to easily charge materials into the open end 13 of the mixing bowl 11 until the material M reaches a level as shown in FIG. 1.

A suitable on-off switch, not shown, for the motor 51 can be provided on the handle and support assembly and when this switch is moved to the on position the motor 51 will drive the main drive gear 53 which in turn will rotate and drive the elements of the power drive assembly as above described for rotating the roller member 42 and the knurled end 46 thereof.

Since the knurled end 46 is in contact with the friction engagement member 17, this will cause the mixing bowl to rotate so that the ribs 16 on the inside of the mixing bowl will act to toss, turn and mix the material M in the mixing bowl 11.

Since the open end 13 of the mixing bowl is above the level of the mixture of material M in the mixing bowl, the contents of the mixing bowl will remain in the mixing bowl and not spill out through the open end.

Mixing is thus continued until the mixture of the material M in the mixing bowl reaches the desired consistency at which time the mixing operation can be stopped. Then, by grasping the handles 30 and 31 the portable mixing apparatus can be pivoted around the axis of the wheel means 26 and 27 onto the outriggers 19*a* and 19*b* until the open end 13 of the mixing bowl drops below the level of the mixture of the materials M in the mixing bowl and the mixed material will be caused to pour out of the open end 13 of the mixing bowl 11 onto the site or place where the mixed materials will be used. Discharge can be expedited by rotation of the mixing bowl.

When the mixing bowl 11 is empty the portable mixing apparatus can again be returned to the rest or charging position wherein the open end 13 of the mixing bowl faces upwardly and then can again be charged with a mixture of materials for mixing in the mixing bowl.

When the mixing operation is completed the mixing bowl can be removed from the carriage assembly, by disconnecting the outer Cotter pin 36 to permit the mixing bowl to be cleaned and then it can be reconnected in position so that it will be available once again for use as may be required.

Since the mixing apparatus has wheels and handle means it can be moved from place to place where mixing can be established or it can be filled with a mixture and the mixture transported to a place where the mixture has to be used.

Thus a simple improved and relatively cheap mixing apparatus has been described which provides the home handy craftsman or do-it-yourselfer a simple means for mixing particularly concrete and transporting the same to a particular point of use and thus provides an advanced tool for doing jobs which heretofore the home handy craftsman had to hire skilled labor to perform.

Further by reason of the size of the machine, the home handy craftsman can perform the mixing operation or do the work in incremental steps within the kind of time frame that is available for accomplishing the particular task undertaken which requires the use of this type apparatus.

It will be understood that the invention is not to be limited to the specific construction or arrangement of parts shown but that they may be widely modified within the invention defined by the claims.

What is claimed is:

1. In a portable mixing apparatus, a. carriage assembly means including, a platform section having wheel means thereon for moving said portable mixing apparatus from place to place, and a handle and support section connected to the platform section and extending upwardly therefrom in a generally vertical plane, b. bearing assembly means mounted for limited linear, floating movement relative the plane of the handle and support section, c. at least two spaced roller assembly means connected to said platform section each disposed in predetermined spaced relation to said bearing assembly means, and a roller member in each of said roller assembly means, d. mixing bowl means defining a mixing chamber having an open end for charging and for discharging materials into and out of said mixing chamber, a closed end, and an axle means extending from said closed end, e. said mixing bowl in operative contact with the roller member in each of said spaced roller assembly means and disposed to permit the axle means to be rotatably mounted and detachably connected in said bearing assembly means for limited oscillatory movement of said mixing bowl during rotation thereof, and f. power drive means connected for driving engagement of one given roller member for rotating the mixing bowl in the assembled position.

2. In a portable mixing apparatus as claimed in claim 1 wherein the roller assembly means are bi-laterally spaced so they respectively lie on opposite sides of a vertical plane extending through the bearing assembly means to provide a three point support for the mixing bowl.

3. In a portable mixing apparatus as claimed in claim 2 wherein, a. said handle and support section have a transverse member thereon having a substantial square opening therethrough, b. said bearing assembly means including, an inner member having a square projecting section thereon sized to fit loosely into said square opening in the transverse member and to abut on one face of said transverse member, an annular outer platelike member operatively mounted on the inner member and in assembled position to abut the opposite face of said transverse member, and c. said inner member having a bearing bore extending end to end therethrough for detachably and rotatably mounting the axle means in said bearing assembly means.

4. In a portable mixing apparatus as claimed in claim 2 wherein a. said platform section is in a substantially horizontal plane, b. the handle and support section includes spaced leg supports to permit the carriage assembly to be placed at a rest position so that the axis of rotation of the mixing bowl and the open end of the mixing bowl are disposed to extend upwardly for charging the mixing chamber formed in the mixing bowl, and c. handle means on said handle and support section for manually pivoting the carriage assembly about the axis of the wheel means for tilting the axis of the mixing bowl and the open end thereof downwardly to control delivery of mixed material from the mixing bowl.

5. In a portable mixing apparatus as claimed in claim 4 including, means connected to the front of the carriage assembly to prevent movement of the portable mixing apparatus when the mixing bowl is pivoted to the discharge position.

6. In a portable mixing apparatus as claimed in claim 2 wherein, a. the power drive means includes, a motor connected to the underside of said platform section, and drive belt means connected between said motor and the driven roller member, and b. guard means connected to said carriage assembly for covering the drive belts of said power drive means.

7. In a portable mixing apparatus as claimed in claim 1 wherein, a. said handle and support section includes handle means for pivoting the carriage assembly about the axis of the wheel means to tilt the axis of the mixing bowl and the open end thereof downwardly for discharge of mixed material from the mixing bowl; and b. means connected to the front of the carriage assembly to prevent movement of the portable mixing apparatus when the mixing bowl is pivoted to the discharge position.

8. In a portable mixing apparatus, a. carriage assembly means including, a platform section having wheel means for moving the portable mixing apparatus from place to place and a handle and support section connected to said platform section and extending generally upward therefrom, b. said handle and support section having leg stands at the lower end to coact with the wheel means so as to permit the carriage assembly to rest on a supporting surface so that the platform section is in a substantially horizontal position, c. bearing assembly means connected in said handle and support section and adapted for limited linear floating movement relatively transverse to the plane of said handle and support section, d. spaced roller assembly means connected to said platform means respectively on opposite sides of a vertical plane through said bearing assembly means, and in predetermined spaced relation thereto, e. a mixing bowl defining a mixing chamber and having an open end for charging material to be mixed into said mixing chamber, a closed end, and an axle means extending from said closed end along the longitudinal axis of said mixing bowl means, f. the axle means of said mixing bowl rotatably and detachably connected in said bearing assembly means so that the periphery of the closed end of the mixing bowl rests on said spaced roller assemblies and the mixing bowl is supported in the carriage assembly so that the axis of rotation thereof and the open end will extend upwardly when the carriage assembly is resting in the charging position, g. power drive means connected to said carriage assembly including, motor means connected to the underside of said platform section, drive chain means connected to said handle and support section for connecting said motor means to at least one roller assembly for rotating the mixing bowl when the power drive means is in operation, and h. said portable mixing apparatus manually moveable to a discharge position for discharging materials from said mixing bowl by rotation of the handle and support section around the axis of the wheel means on said platform section.

9. In a portable mixing apparatus as claimed in claim 8 wherein the roller assembly means are bi-laterally spaced so they respectively lie on opposite sides of a vertical plane extending through the bearing assembly means to provide a three point support for the mixing bowl.

10. In a portable mixing apparatus as claimed in claim 9 wherein, a. said handle and support section having a transverse member thereon having a substantial square opening therethrough, b. said bearing assembly means including, an inner member having a square projecting section thereon sized to fit loosely into said square opening in the transverse member and to abut on one face of said transverse member, an annular outer platelike member operatively mounted on the inner member and in assembled position to abut the opposite face of said transverse member, and c. said inner member having a bearing bore extending end to end therethrough for detachably and rotatably mounting the axle means in said bearing assembly means.

11. In a portable mixing apparatus as claimed in claim 8 wherein, a. said handle and support section includes handle means for pivoting the carriage assembly about the axis of the wheel means to tilt the axis of the mixing bowl and the open end thereof downwardly for discharge of mixed material from the mixing bowl; and b. means connected to the front of the carriage assembly to prevent movement of the portable mixing apparatus when the mixing bowl is pivoted to the discharge position.

12. In a portable mixing apparatus, a. carriage assembly means including, a platform section, and a support section connected to the platform section and extending upwardly therefrom in a generally vertical plane, b. at least two roller assembly means connected to said platform section in spaced relation to each other, and a roleler member in each of said roller assembly means respectively disposed so that the outer surfaces of each roller member face each other, and said respective roller members each lying in the same plane transverse to the platform section, c. bearing assembly means mounted in the support section and spaced from the respective roller members to form a predetermined operative three point support in the mixing apparatus, d. mixing bowl means defining a mixing chamber having an open end for charging and discharging materials into and out of said mixing chamber, a closed end, and an axle means extending from said closed end, e. said mixing bowl in operative contact with the respective roller member in each of said spaced roller assembly means and disposed to permit the axle means to be rotatably and detachably connected in said bearing assembly means, and f. power drive means including, a driving motor on the underside of said platform remote from the roller assembly means, and a drive transmission assembly connecting the drive motor to at least one given roller member for driving the same and said mixing bowl at a desired optimum speed of rotation.

13. The portable mixing apparatus as claimed in claim 12 including, a. wheel means mounted on said platform section, b. handle means connected to said platform section for pivoting the carriage assembly about the axis of the wheel means to tilt the axis of the mixing bowl for discharging mixed material from the open end of the mixing bowl, c. spaced leg supports connected to said platform section adjacent the handle means to permit the carriage assembly to be placed at a rest position for charging the open end of the mixing bowl, and d. support means connected to the front of the platform section to prevent movement of the mixing apparatus when the mixing bowl is pivoted to the discharge position.

14. In the portable mixing apparatus as claimed in claim 12 wherein, a. said bearing assembly means is mounted in the support section for limited linear floating movement relative the plane of the support section, and b. said mixing bowl having limited oscillatory movement during rotation thereof in the said bearing assembly means.

* * * * *